US006301786B1

(12) United States Patent
Oswald et al.

(10) Patent No.: US 6,301,786 B1
(45) Date of Patent: Oct. 16, 2001

(54) ELECTRIC DRY RAZOR

(75) Inventors: Mathias Oswald; Otto Pirmayer, both of Werndorf (AT)

(73) Assignee: Payer Elektroprodukte Ges.m.b.H., St. Bartholomä (AT)

( * ) Notice: Subject to any disclaimer, the term of this patent is extended or adjusted under 35 U.S.C. 154(b) by 0 days.

(21) Appl. No.: 09/509,206

(22) PCT Filed: Jul. 19, 1999

(86) PCT No.: PCT/AT99/00180

§ 371 Date: Mar. 24, 2000

§ 102(e) Date: Mar. 24, 2000

(87) PCT Pub. No.: WO00/06348

PCT Pub. Date: Feb. 10, 2000

(30) Foreign Application Priority Data

Jul. 24, 1998 (AT) ..... 505/98 U

(51) Int. Cl.[7] ..... B26B 19/04
(52) U.S. Cl. ..... 30/43.92; 30/527
(58) Field of Search ..... 30/43.92, 43.9, 30/346.51, 43.91, 43.8, 531, 527

(56) References Cited

U.S. PATENT DOCUMENTS

| | | | | |
|---|---|---|---|---|
| 2,194,815 | * | 3/1940 | Testi | 30/531 |
| 3,045,346 | * | 7/1962 | Akerib | 30/43.92 |
| 3,319,334 | * | 5/1967 | Bond et al. | 30/43.92 |
| 3,797,109 | | 3/1974 | Yamada et al. . | |
| 3,911,573 | | 10/1975 | Limberg . | |
| 5,343,621 | * | 9/1994 | Hildebrand et al. | 30/527 X |
| 6,115,924 | * | 9/2000 | Oldroyd | 30/527 |

FOREIGN PATENT DOCUMENTS

| | | |
|---|---|---|
| 0 673 728 A1 | 9/1995 | (EP) . |
| 0 721 824 A2 | 7/1996 | (EP) . |
| 2 266 070 A | 10/1993 | (GB) . |

* cited by examiner

*Primary Examiner*—Douglas D. Watts
(74) *Attorney, Agent, or Firm*—Kevin E. Joyce

(57) ABSTRACT

A dry shaver includes at least one shaving blade which is arranged in a pivotable head frame closed on its sides and which cooperates with cutters oscillating in the longitudinal direction of the shaving blades. The head frame is detachably connected with a base part which includes a cutter driving mechanism. The head frame is designed in two parts, wherein an outer head part carrying the shaving blade(s) is pivotally connected with a part of the head frame that is detachably fixed to the base part, the pivotal connection being about an approximately central pivot axis extending transverse to the oscillation direction of the cutters.

9 Claims, 8 Drawing Sheets

ELECTRIC DRY RAZOR

This application is the national phase of international application PCT/AT99/00180filed Jul. 19, 1999 which designated the U.S.

BACKGROUND OF THE INVENTION

1. Field of the Invention

The invention relates to a dry shaver including at least one shaving blade which is arranged in a pivotable head frame closed on its sides and cooperates with cutters oscillating in the longitudinal direction of the shaving blades, wherein the shaver head is detachably connected with the base part including the driving mechanism.

2. Prior Art

Dry shavers are known in various configurations. Besides dry shavers comprising rotating cutters, in which the shaving blades having relatively small diameters are resiliently arranged in a head frame, dry shavers are above all known, in which a driving motor is arranged in a base part and coupled with one or several cutter blade blocks or lamella carriers, whereby the lamellae or cutter blades of the cutter blade blocks or lamella carriers are set in an oscillating movement. The direction of oscillation of such cutter blade blocks extends in the direction of the axis of the enveloping curve of the lamellae, wherein said lamellae or cutter blades cooperate with shaving blades which, in turn, may be designed in a curved manner, too. The curvature of the shaving blades follows the enveloping curve or enveloping surface of the lamellae or cutter edges, the length of such a shaving blade being measured in the axial direction of the curvature of the enveloping surface. A plurality of such cutter blade blocks may be driven in parallel to carry out an oscillating movement in same direction or in opposite direction, wherein the shaving blade comprises a corresponding plurality of curved surfaces cooperating with the enveloping surfaces of the lamellae. The shaving blade, as a rule, is arranged in a head frame and may be removed together with the head frame for the purpose of cleaning. To this end, the head frame is detached from the base part, wherein, as a rule, at least the shaving blade is separated from the base part together with the head frame. After this, the oscillating cutters of the cutter blade blocks and the shaving blade can be cleaned separately, whereupon the operating condition may be restored by simple assemblage. In addition to those configurations, configurations have been known, in which the cutter blade blocks are mounted in the head frame and are removed along with the head frame. In such configurations cleaning is somewhat more cumbersome.

The known configurations or arrangements of shaving blades and cutter blade blocks allow for a certain degree of elastic resilience. Both the relatively thin-walled shaving blade, which is elastically deformable, and the cutter blade block, which is resiliently connected with the driving mechanism, may yield under compressive stress, said yielding movement serving to enhance adaptation to the skin to be shaved. Such yielding movements are, however, delimited by the boundary edges of the head frame. In order to enable a better adaptation to the contour of the skin, it is known to connect the head frame, together with the shaving blade and the oscillating cutters, with the base part in a pivotable manner, whereby a pivot axis is provided in the known configurations, which extends substantially parallel with the axis of the enveloping surface of the lamellae, or the axis of the curvature of the shaving blade. That pivotability in the event of several cutter blade blocks set in parallel oscillation, in the first place, serves to getting a plurality of such cutter blade blocks and shaving blades into an operating position at the same time. Depending on the length of the shaving blades, an application behavior that varies over the length of the shaving blade will, however, result from the varying contour of the skin, which must be compensated for by the user of such a dry shaver by constantly orienting the base part, and hence the shaving blades, in a suitable manner. In the extreme case, only a portion of the length of the shaving blades is in active engagement with the skin to be shaved such that the time necessary for a smooth shave is substantially increased, requiring appropriate corrections several times.

SUMMARY OF THE INVENTION

The invention aims to equalize the application pressure of shaving blades and oscillating cutter blades at different contours of the skin without involving frequent corrections of the angular position of the base part relative to the skin and to provide a configuration that enables the optimum adaptation of the cutter head to the contour of the skin without requiring an increased attention by the user of the shaver and without calling for elevated cleaning expenses. To solve this object, the configuration according to the invention essentially consists in that the head frame is designed in two parts, wherein the outer head part carrying the shaving blade(s) is connected with the part of the head frame that is detachably fixed to the base part, about an approximately central pivot axis extending transverse to the oscillation direction of the cutters. Due to the fact that the head frame, which is closed on its sides, is designed in two parts and the respectively outer part of the head frame is pivotably hinged to the first part of the head frame, which is detachably fixed to the base part of the shaver, a closed configuration is provided, which can be removed from the base part as a unit and is easy to clean. At the same time, the pivotability of the outer part of the head frame ensures that an accordingly high pivotability is feasible without the skin colliding with the edges of the head frame and thereby impeding the pivotal movement of the shaving blade and of the lamellae. By removing the entire two-part head frame, at least the shaving blade can be separated from the base part and from the lamella block so as to enable simple cleaning. When pivoting the outer head part, also the external edges of the outer head part are always pivoted simultaneously therewith such that the pivotal movement will in no way be impeded by the head frame and an accordingly large pivot angle will be available.

Sealing of the two parts of the head frame relative to each other may be effected in a conventional and particularly simple manner with the configuration being devised such that the pivotable outer head part is connected with the head part detachably fixed to the base part, via sealing surfaces or packings. While the pivotability of the shaving blade within the head frame as a function of the pivoted position always involves more or less large passage openings for the cut hairs of a beard and hence a high risk of choking, the closed configuration comprising a pivotable outer head part connected via sealing surfaces or packings with the head part detachably fixed to the base part results in the cut hairs of the beard being safely received in the interior of the head frame so as to be readily removed upon removal of the entire head frame, easy cleaning of the shaving blades and of the cutters, thus, being feasible.

Advantageously, the configuration according to the invention is devised such that the pivot axis of a cutter-carrying block and the pivot axis of the outer head part are located in a longitudinal center plane of the base part. With such an arrangement of the pivot axis and, in particular, in an arrangement in which the pivot axis of a cutter-carrying block and the pivot axis of the outer head part register with each other, the resilient connection between the cutter block and the driving mechanism substantially is stressed in the same manner as in conventional designs with additional forces being avoided.

The relatively high pivotability of the outer head part relative to the head part that is detachably fixed to the base part may be delimited in a simple manner, wherein the configuration preferably is devised such that the pivotability of the pivotable outer head part is delimited by stops on the head part that is detachably fixed to the base part.

Resetting of the pivotable outer part of the head frame into a position substantially parallel with the upper edge of the base part may be realized by the aid of springs arranged therebetween. In a particularly simple manner, the configuration in this case may be devised such that the packing is designed as a spring.

BRIEF DESCRIPTION OF THE DRAWINGS

In the following, the invention will be explained in more detail by way of exemplary embodiments schematically illustrated in the drawing. Therein.

DETAILED DESCRIPTION OF PREFERRED EMBODIMENTS OF THE INVENTION

Figure 1:
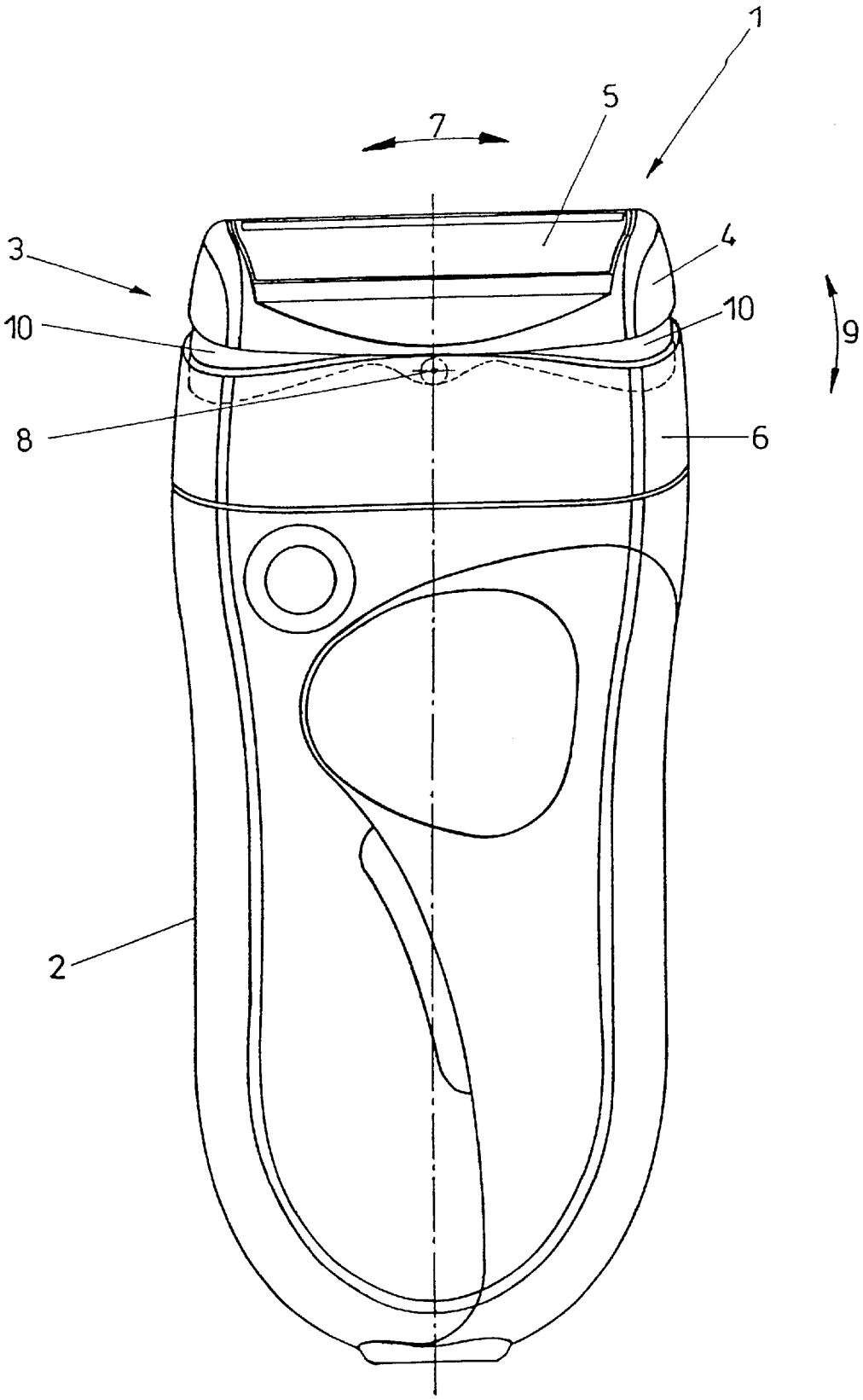
FIG. 1 is a front view of a first embodiment of the dry shaver according to the invention comprising a pivotable head part.

FIG. 1 depicts a dry shaver 1 comprising a base part 2 as well as a head frame 3. The head frame 3, which is designed in two parts, comprises an outer head part 4 accommodating the shaving blades 5 as well as a head part 6 which is detachably fixed to the base part 2. The shaving blades 5 arranged in the outer head part cooperate with cutter blades or lamellae not illustrated in detail, the cutter blades or lamellae oscillating in the direction of the double arrow 7. The outer head part 4 is connected with the head part 6 detachably fixed to the base part 2, so as to be pivotable about a pivot axis 8 extending transverse to the oscillation direction 7 of the cutter blades or lamellae. Thus, the pivotability of the outer head part 4 comprising the shaving blades 5 is ensured in the direction of the double arrow 9, thereby enabling the outer head part comprising the shaving blades 5 to by optimally adapted to the contour of the skin. The outer head part 4 comprises sealing surfaces 10 which cooperate with the head part 6 that is detachably fastened to the base part 2, in a manner so as to ensure the safe reception of the cut hairs of the beard in the interior of the head frame without involving the risk of the cutting head to become dirty.

Figure 2:
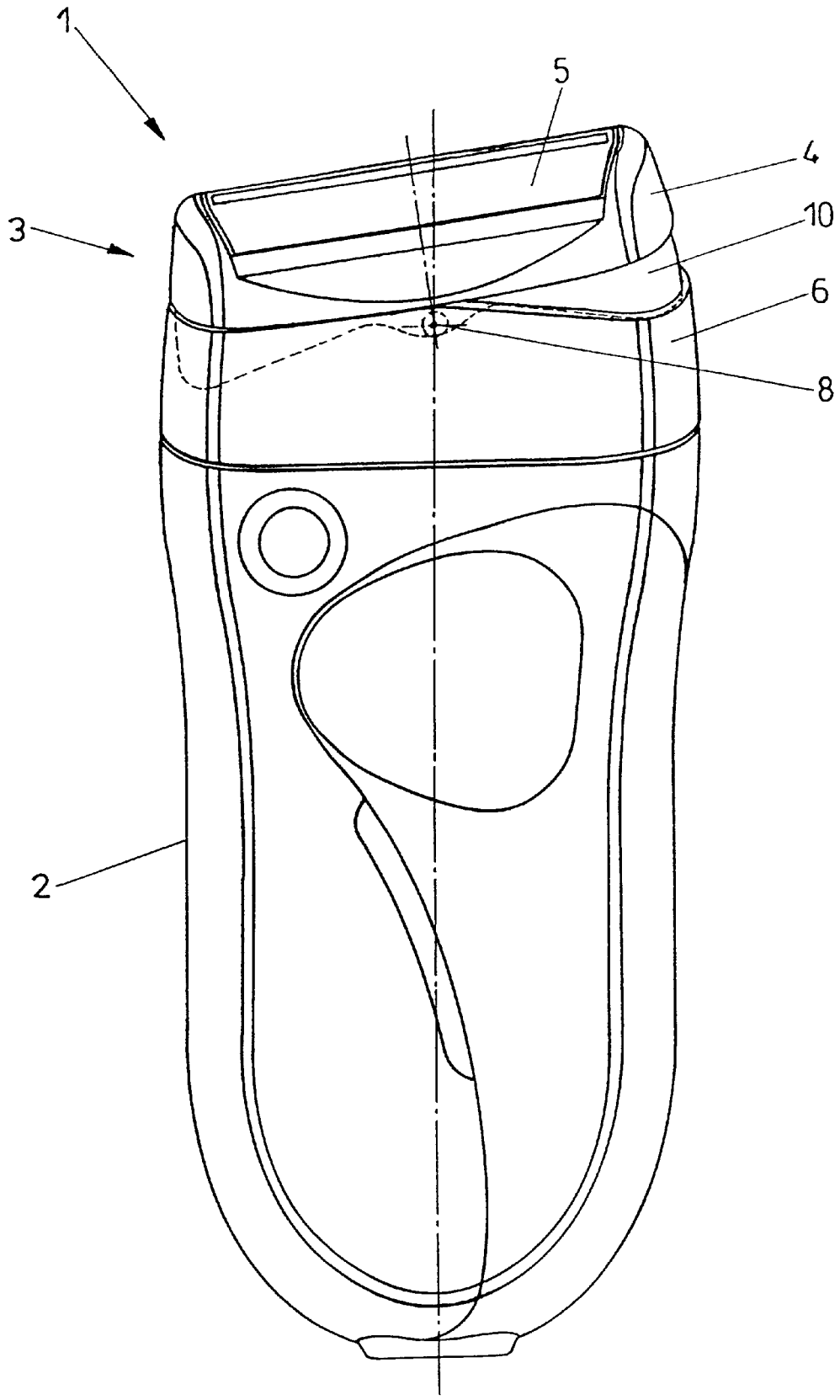
FIG. 2 depicts the dry shaver according to FIG. 1 comprising a pivotable head part in a first pivoted position.

FIG. 2 shows the dry shaver 1 illustrated in FIG. 1, with the outer head part 4 accommodating the shaving blades 5 having been pivoted into a pivoted position about the pivot axis 8. The sealing surfaces 10 cooperating with the head part 6 ensure the safe sealing of the head frame 3 also in the pivoted position.

Figure 3:
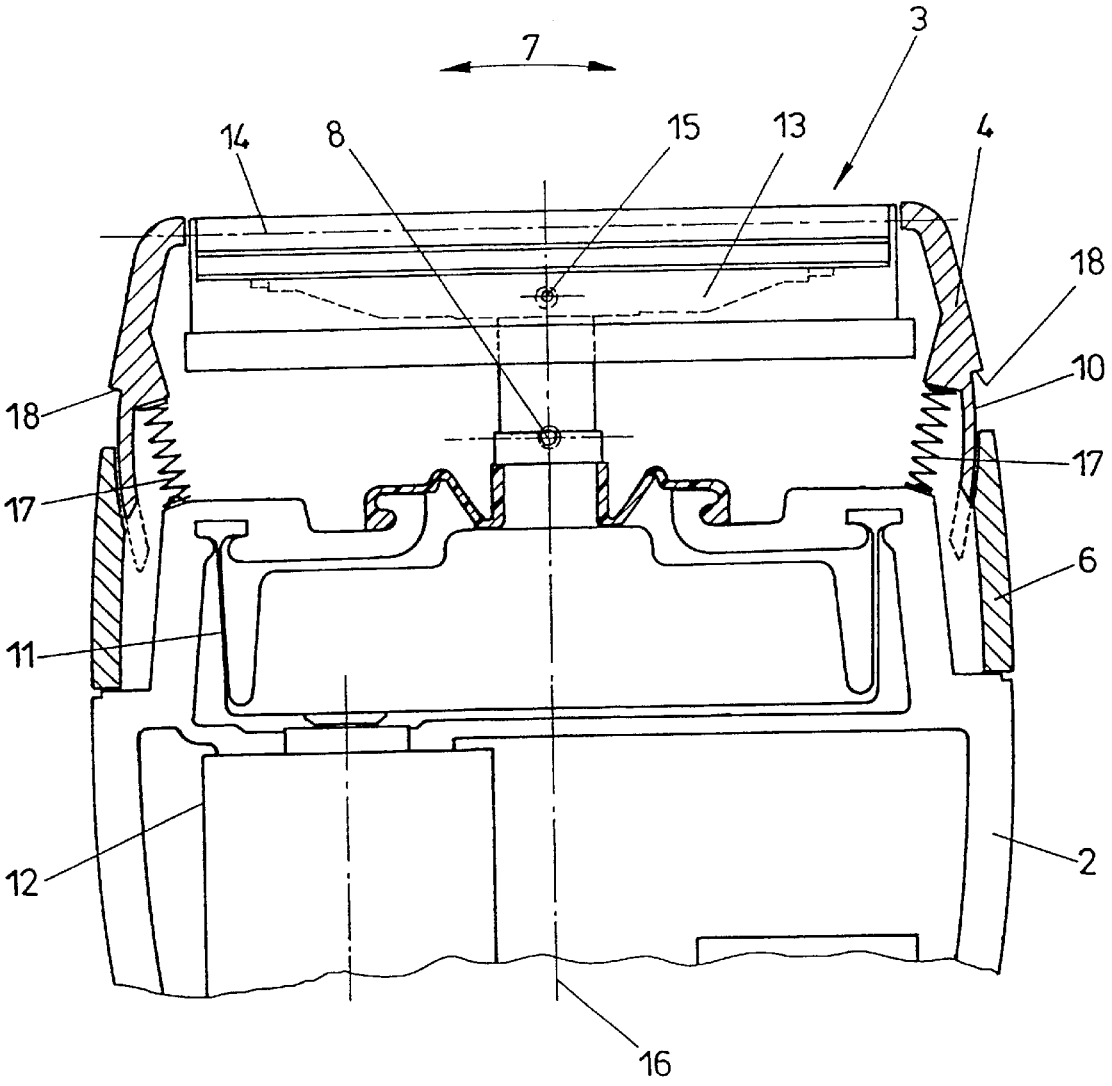
FIG. 3 is a partial section through the dry shaver according to the FIG. 1.

FIG. 3 represents the dry shaver illustrated in FIG. 1 in partial section. The reference numerals have been retained for identical parts. The driving mechanism 11, which cooperates with a motor 12, is arranged in the base part 2, setting the lamella carriers 13 in an oscillating movement in the direction of the double arrow 7. The enveloping curve of the cutter blades or lamellae is indicated by the dot-and-dash line 14. The pivot axis 15 of the lamella carrier 13 like the pivot axis 8 of the outer head part is located in the longitudinal center plane of the base part 2 indicated by the dot-and-dash line 16. In order to reset the outer head part 4 of the head frame 3, which is pivotable about the pivot axis 8, into a position substantially parallel with the upper edge of the base part 2, springs 17 are provided, which are supported between the outer head part 4 and the head part 6. In order to delimit the pivotability of the outer head part 4 relative to the head part 6 detachably connected with the base part 2, stops 18 are provided on the outer head part 4.

Figure 4:
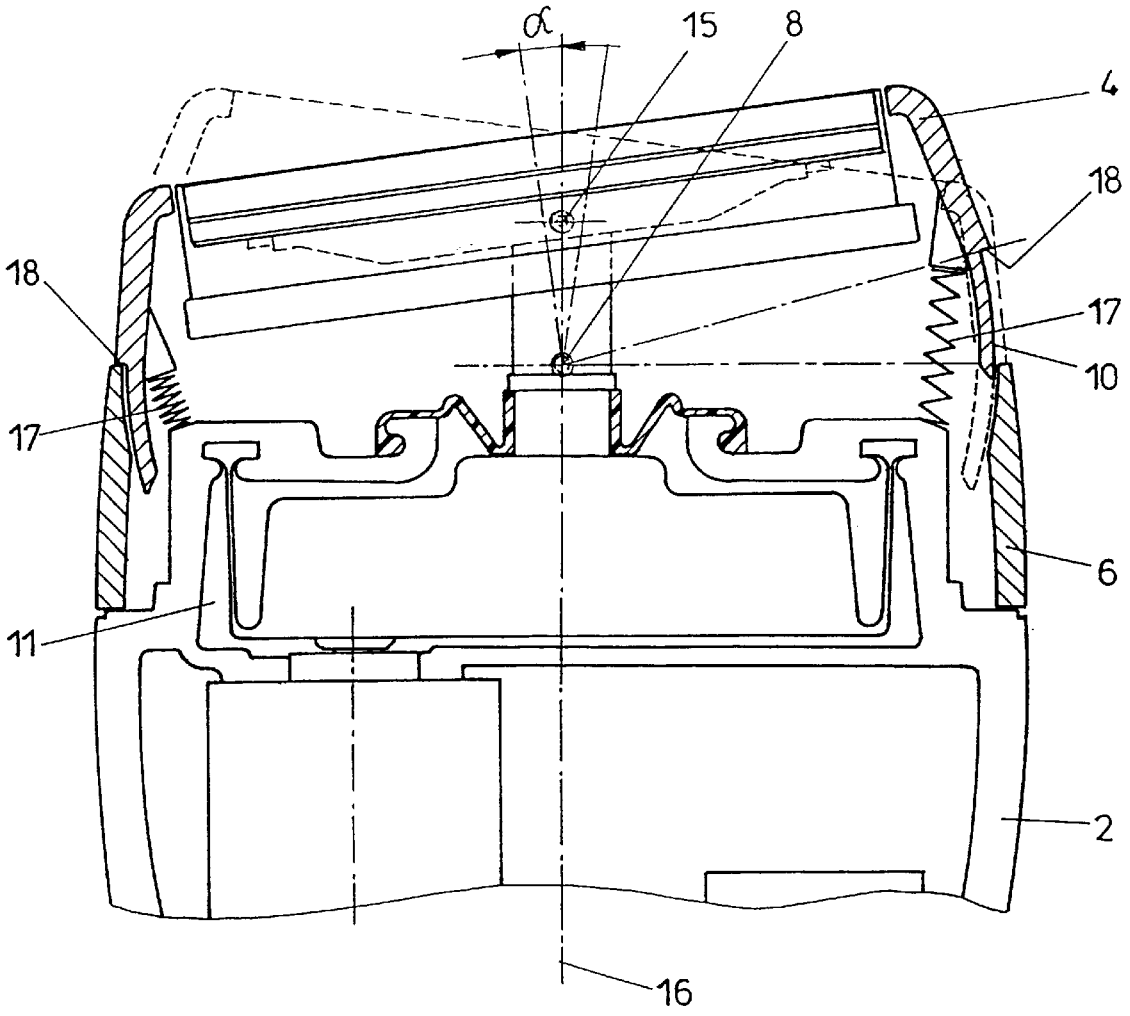
FIG. 4 is a partial section through the dry shaver according to FIG. 2.

FIG. 4 depicts the dry shaver according to FIG. 2 in partial section, with the pivotable head part 4 having been pivoted about the pivot axis 8 as far as to the stop 18. It is clearly apparent that even in case of a large pivoting angle a of the head part 4 the delimiting edges of the outer head part 4 do not substantially project beyond the shaving blades 5, thus ensuring the optimum adaptation of the shaving blades to the contour of the skin.

Figure 5:
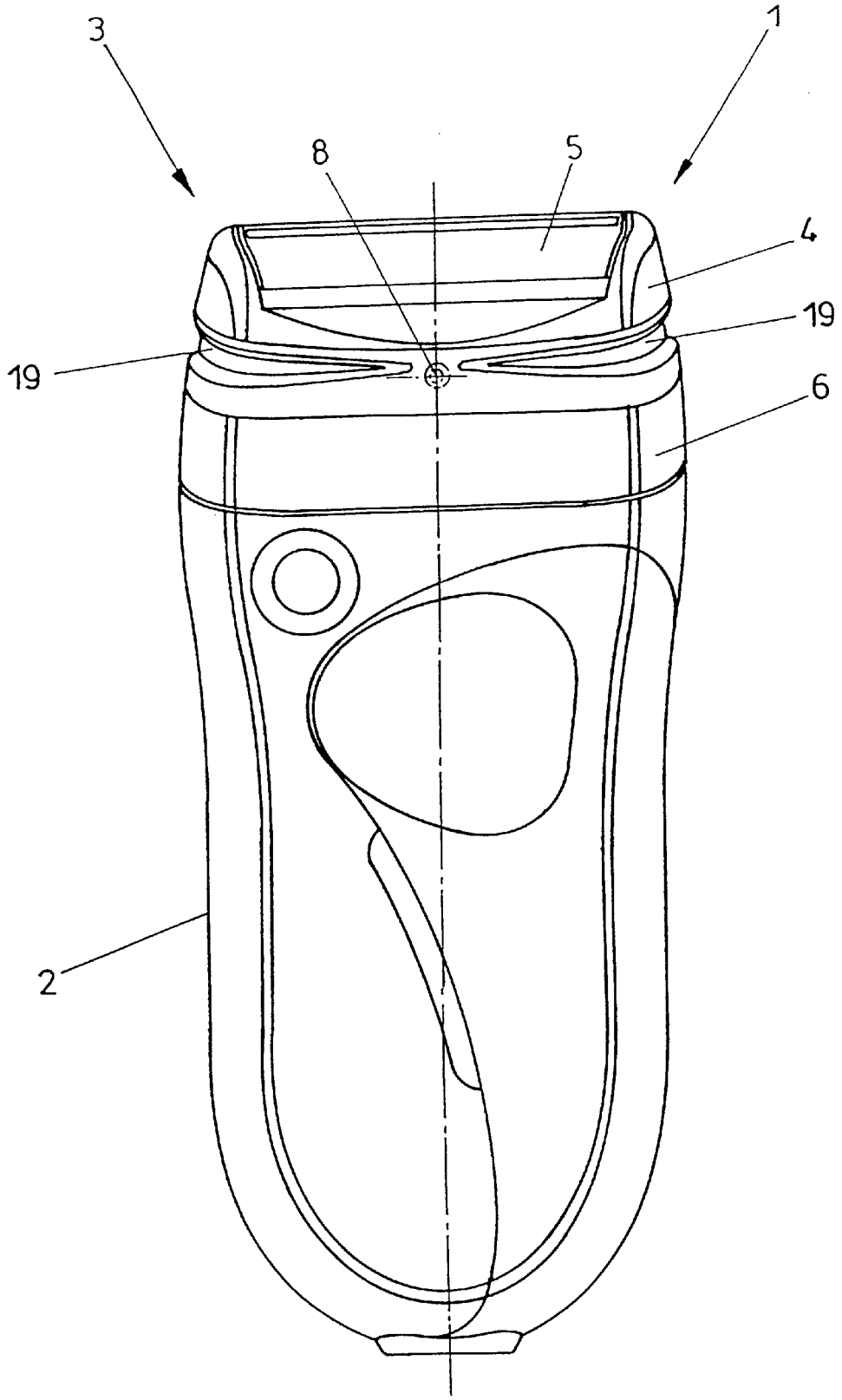
FIG. 5 is a front view of a second embodiment of the dry shaver according to the invention comprising a pivotable head part.

FIG. 5 illustrates an embodiment of a dry shaver modified in view of FIG. 1, wherein the same reference numerals have again been retained for identical parts. In the instant embodiment, packings 19 are provided between the outer head part 4 in which the shaving blades 5 are arranged and the head part 6 which is detachably fixed to the base part 2.

Figure 6:
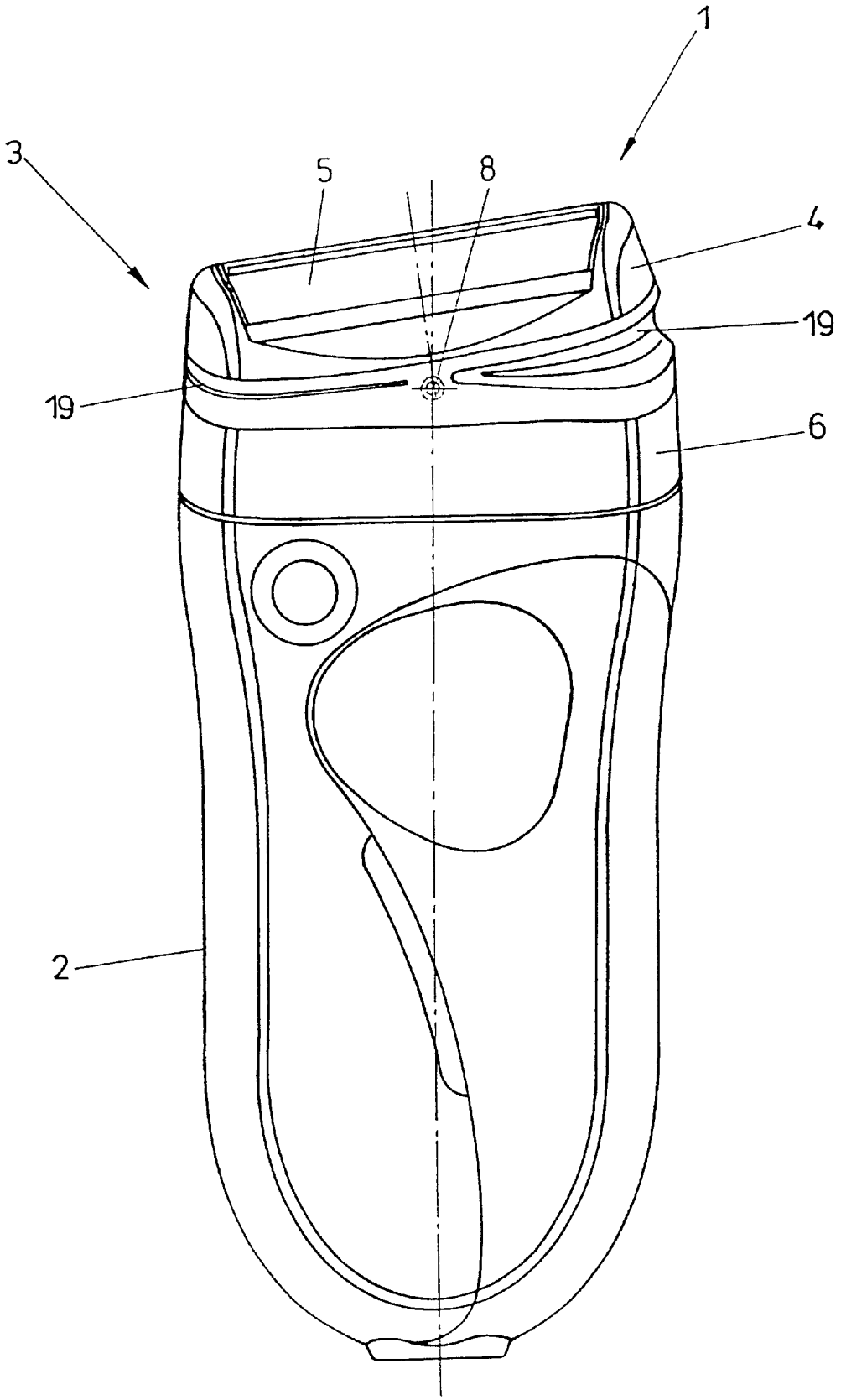
FIG. 6 depicts the dry shaver according to FIG. 5 comprising a pivotable head part in a pivoted position.

FIG. 6 shows the configuration according to FIG. 5 with the outer head part 4 having been pivoted about the pivot axis 8 in a manner analogous to FIG. 2.

Figure 7:
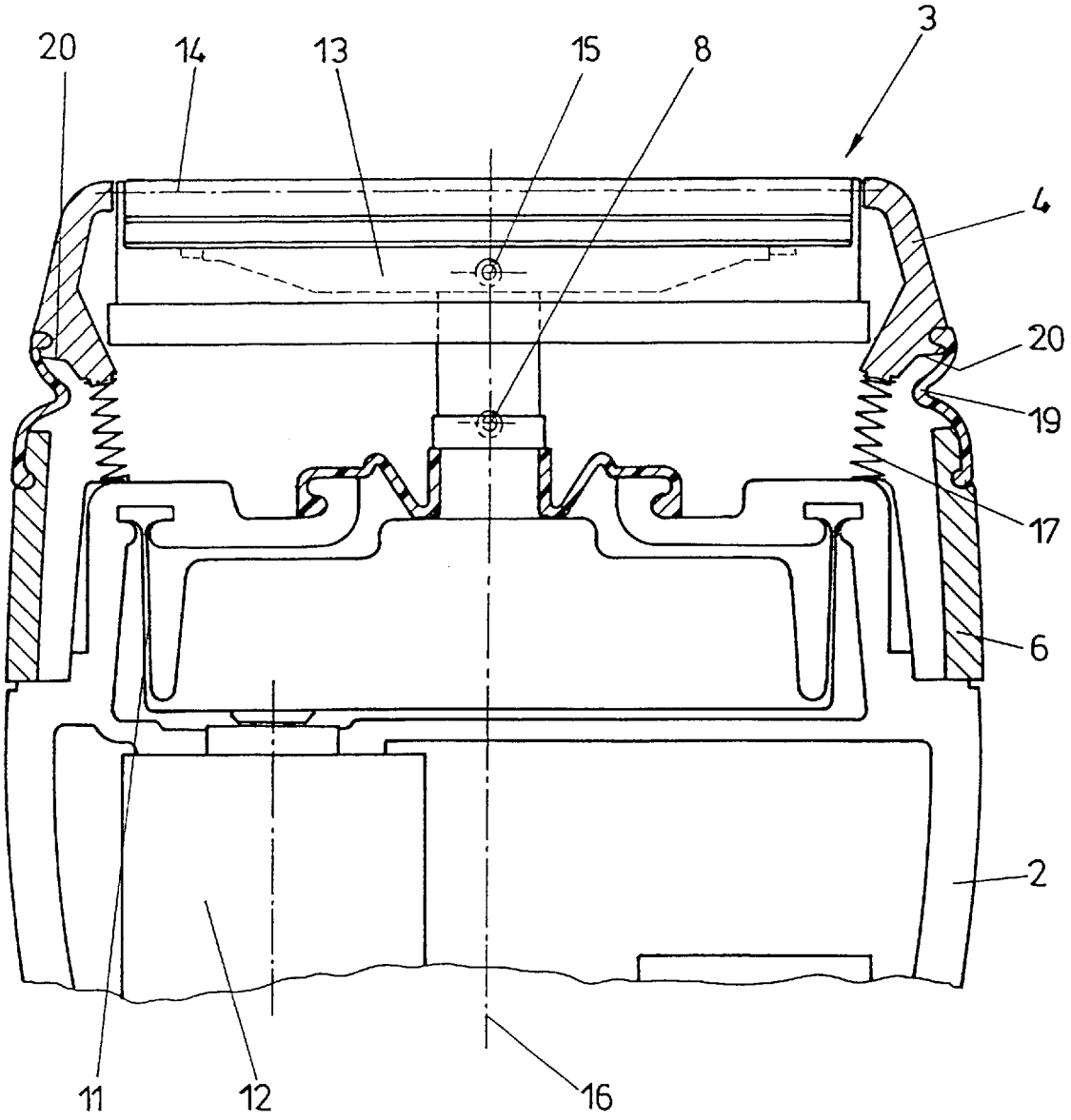
FIG. 7 is a partial section through the dry shaver according to FIG. 5.

FIG. 7 depicts a partial section through the configuration according to FIG. 5 with the pivotability of the outer head part 4 about the pivot axis 8 being delimited by stops 20 arranged on the outer head part 4.

Figure 8:
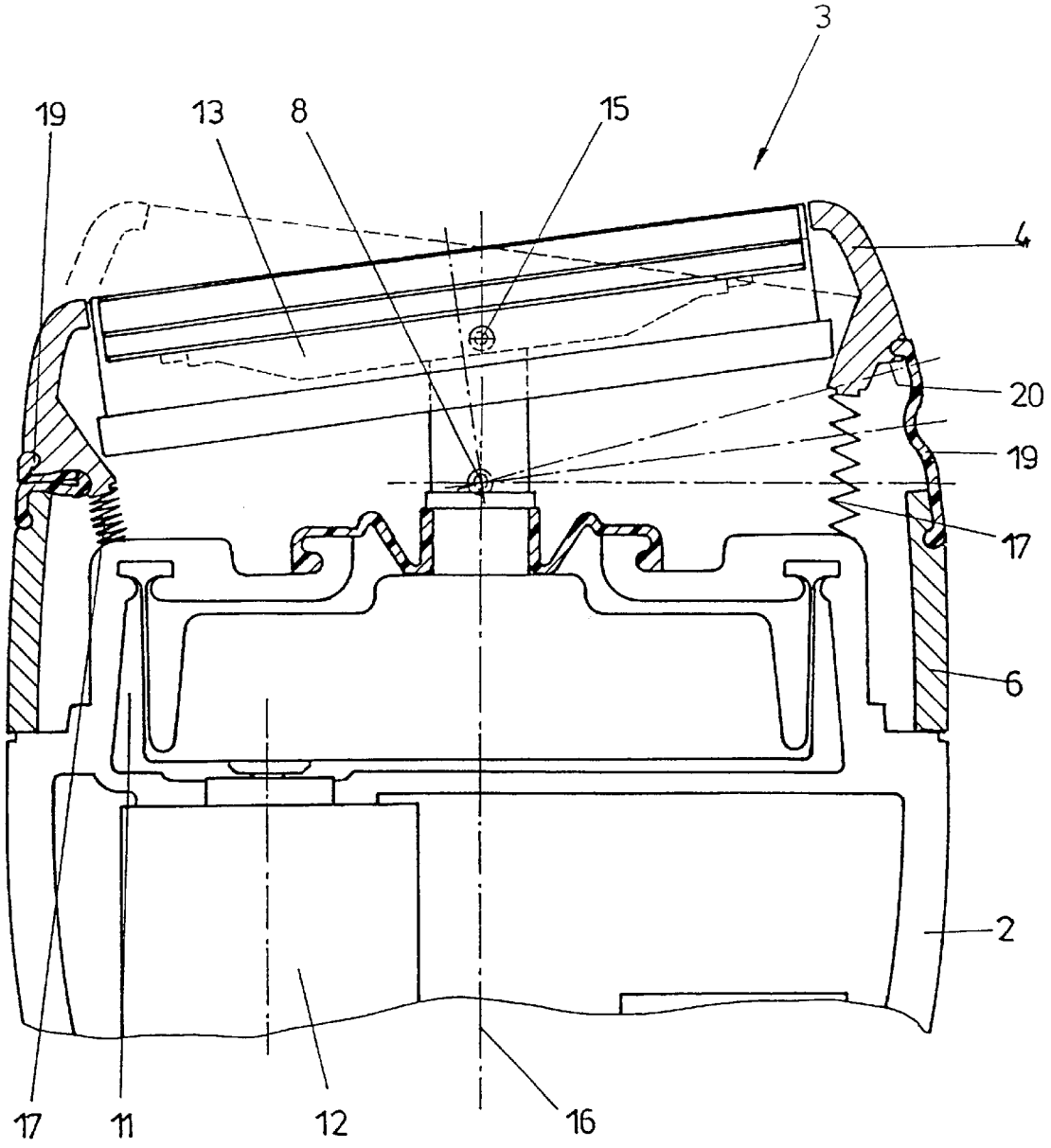
FIG. 8 is a partial section through the dry shaver according to FIG. 6.

FIG. 8 shows the configuration of a dry shaver according to FIG. 5 with the head part 4 having been pivoted into a pivoted position about the pivot axis 8.

What is claimed is:

1. A dry shaver of the type having at least one shaving blade which is arranged in a pivotable head frame which is closed on its sides, the shaving blade cooperating with cutters oscillating in a longitudinal direction of the shaving blade and the head frame being detachable connected with a base part which supports a driving mechanism for oscillating the cutters, the improvement comprising the head frame being formed by a first head part which carriers the shaving blade and which is pivotally joined to a second head part which detachably connects the head frame to the base part, said pivotal joinder of the first and second head parts being about a pivot axis which is substantially centrally located in the head frame and which extends transverse to the longitudinal oscillating direction of the cutters.

2. A dry shaver according to claim 1, wherein sealing surfaces are provided between the first and second head parts.

3. A dry shaver according to claim 1 or 2, further comprising a cutter-carrying block pivotally connected to the driving mechanism about an axis which, together with the pivot axis of the first and second parts, lie in a longitudinal center plane of the base part.

4. A dry shaver according to claim 1 or 2, further comprising stops provided on the second head part to limit the pivotability of the first head part relative to the second head part.

5. A dry shaver according to claim 3, further comprising stops provided on the second head part to limit the pivotability of the first head part relative to the second head part.

6. A dry shaver according to claim 1 or 2, further comprising at least one spring interposed between the first head part and the base part.

7. A dry shaver according to claim 3, further comprising at least one spring interposed between the first head part and the base part.

8. A dry shaver according to claim 4, further comprising at least one spring interposed between the first head part and the base part.

9. A dry shaver according to claim 5, further comprising at least one spring interposed between the first head part and the base part.

* * * * *